US008960859B2

(12) United States Patent
Sekino

(10) Patent No.: US 8,960,859 B2
(45) Date of Patent: Feb. 24, 2015

(54) INK JET PRINTING APPARATUS

(71) Applicant: Canon Kabushiki Kaisha, Tokyo (JP)

(72) Inventor: Takeshi Sekino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/870,163

(22) Filed: Apr. 25, 2013

(65) Prior Publication Data

US 2013/0300809 A1 Nov. 14, 2013

(30) Foreign Application Priority Data

May 8, 2012 (JP) ..... 2012-106983

(51) Int. Cl.
*B41J 2/14* (2006.01)
*B41J 2/175* (2006.01)

(52) U.S. Cl.
CPC ..... *B41J 2/1752* (2013.01)
USPC ..... 347/49; 347/86

(58) Field of Classification Search
USPC ..... 347/49, 85, 86, 87
See application file for complete search history.

(56) References Cited

U.S. PATENT DOCUMENTS 5,359,357 A * 10/1994 Takagi et al. ..... 347/49
5,552,816 A * 9/1996 Oda et al. ..... 347/86
6,027,209 A * 2/2000 Menendez et al. ..... 347/85
7,300,142 B1 * 11/2007 Usui et al. ..... 347/86
7,537,312 B2 5/2009 Sekino et al.
7,566,108 B2 7/2009 Nojima et al.
7,905,572 B2 * 3/2011 Anderson et al. ..... 347/49
8,348,401 B2 1/2013 Sekino et al.

FOREIGN PATENT DOCUMENTS

CN 1891474 A 1/2007
JP 4333980 B2 9/2009

OTHER PUBLICATIONS

Office Action issued in Chinese Patent Application No. 201310165716.2, dated Sep. 22, 2014.

* cited by examiner

*Primary Examiner* — Anh T. N. Vo
(74) *Attorney, Agent, or Firm* — Fitzpatrick, Cella, Harper & Scinto

(57) ABSTRACT

An ink jet apparatus includes a head cartridge; an ink tank having an ink supply portion to be connected to an ink inflow portion of the head cartridge, and a first engagement portion to engage the head cartridge; a carriage on which the head cartridge is detachably mounted; and a tank holding member, which is swingably supported by the carriage to engage a second engagement portion of the ink tank. When the head cartridge and ink tank are mounted on the carriage, the ink tank is pivoted around the first engagement portion by receiving a force exerted against the ink supply portion via the ink inflow portion, and the tank holding member is pushed by the second engagement portion and is moved.

9 Claims, 14 Drawing Sheets

INK JET PRINTING APPARATUS

BACKGROUND OF THE INVENTION

1. Field of the Invention

The present invention relates to an ink jet printing apparatus that ejects ink onto a printing medium to print characters and images, and relates particularly to an ink jet printing apparatus wherein a head cartridge that ejects ink and ink tanks are detachably mounted on a carriage.

2. Description of the Related Art

A well-known ink jet printing apparatus is a serial type ink jet printer, i.e., a type wherein a head cartridge, which includes a print head for ejecting ink, is moved in a direction perpendicular to the direction in which a printing medium is conveyed, while simultaneously, ink is ejected from the print head onto the printing medium to form an image. In the serial type ink jet printing apparatus (hereinafter referred to simply as a printing apparatus), a head cartridge and an ink tank, wherein ink to be supplied to the head cartridge is retained, are detachably mounted on a carriage. With this arrangement, the ink tank alone can be replaced when the ink therein has been exhausted, and the print head alone can be replaced when the print head has malfunctioned, and since these procedures are individually performed only as needed, operating costs can be reduced.

High-quality image printing, available even for professional use, has also been requested for an ink jet printing apparatus, and more ink color variations have been developed as one measure for providing high-quality printing. For example, an arrangement wherein, for performing printing, ink tanks of eight to twelve colors have been mounted is employed for a single head cartridge.

Further, as described in Japanese Patent No. 4,333,980, a fixing member is provided for a carriage to secure a head cartridge to the carriage. This fixing member includes a lever having an operating portion and pressure springs that press the head cartridge against the carriage, and secures the head cartridge to the carriage as the lever is pivoted. When the head cartridge is to be released from the carriage, the lever of the fixing member must be pivoted by lifting the operation portion.

However, according to the above described technique, it has been found that when, in response to a high-quality image printing request, the number of ink tanks to be mounted is increased in order to correspond to an ink color variation count, a force applied to hold a head cartridge is reduced. The reason that the holding force for the head cartridge is reduced is as follows.

Specifically, ink supply portions are formed in the bottoms of the individual ink tanks, while a head cartridge has ink inflow portions at positions that are opposed to the individual ink supply portions when the ink tanks are mounted. When the ink tanks are mounted on the head cartridge, the ink supply portions of the ink tanks are connected to the ink inflow portions of the head cartridge to supply ink from the ink tanks to the print heads of the head cartridge. In order to prevent the leakage of ink from the joints of the head cartridge and the ink tanks during the ink supply operation, generally, an arrangement is employed wherein the ink tanks and the head cartridge closely contact each other, by employing, for example, coupling members formed of a resilient material. Therefore, the ink tanks and the head cartridge receive a repulsive force from the coupling members. When the number of ink tanks to be mounted on the print head is increased, accordingly, the total repulsive force the head cartridge receives from the coupling members when the ink tanks are mounted is also increased. As a result, the repulsive force may be greater than the force with which the head cartridge is pressed against the carriage, and the holding force for the head cartridge may become too low to hold and maintain the head cartridge at a predetermined position, and thus, that image forming would be adversely affected.

As one method for resolving this problem, the force applied to press and hold the print head can be increased. However, as a result, a very great operation force is required to mount the head cartridge on the carriage, and the operability is degraded. Furthermore, when the force applied by the pressure springs provided for the fixing portion is to be increased, a special, rigid material must be employed in order to prevent the deformation of the fixing member, and a complicated linking mechanism is also required in order to reduce the operation force of the fixing member.

As another method for resolving the above described problem, a member different from the fixing member is provided for the carriage to increase the holding force for the head cartridge. In this case, however, not only the manufacturing cost for the product is increased, but also a space for mounting the other member is also required, and a new problem will have occurred, in that the size of the entire apparatus is increased.

SUMMARY OF THE INVENTION

One objective of the present invention is to provide an ink jet printing apparatus that can prevent the complicating of the apparatus arrangement and the increase in the manufacturing cost, and that can appropriately hold a head cartridge relative to a carriage.

To achieve the above objective, the present invention has the following arrangement.

Specifically, an ink jet apparatus according to the present invention comprises: a head cartridge having an ink inflow portion; an ink tank, for which an ink supply portion to be connected to the ink inflow portion and a first engagement portion to engage the head cartridge are formed, and in which ink to be supplied to the head cartridge is to be stored; a carriage on which the head cartridge is detachably mounted; and a tank holding member, swingably supported by the carriage, for engaging a second engagement portion of the ink tank, wherein, when the head cartridge and ink tank are mounted on the carriage, the ink tank is pivoted around the first engagement portion by receiving a force exerted against the ink supply portion via the ink inflow portion, and the tank holding member is pushed by the second engagement portion and is moved.

According to the present invention, when multiple ink tanks are employed, the head cartridge can also be appropriately held and fixed with respect to the carriage, and accurate, high-quality image forming can be performed. Further, since an additional complicated mechanism or member is not required for the apparatus, an inexpensive apparatus can be provided.

Further features of the present invention will become apparent from the following description of exemplary embodiments (with reference to the attached drawings).

DETAILED DESCRIPTION OF THE EMBODIMENTS

The embodiments of the present invention will now be described in detail by employing the drawings. It should be noted that the same reference numbers are employed for all of the drawings to denote like or corresponding portions.

First Embodiment

First, an ink jet printing apparatus according to a first embodiment of the present invention will be described while referring to FIG. 1 to FIGS. 13A and 13B. The ink jet printing apparatus of this embodiment is a so-called serial type ink jet printing apparatus (hereafter referred to simply as a printing apparatus) equipped with a carriage. In this embodiment, the printing apparatus performs the printing of a printing medium by driving a plurality of print heads to eject ink based on print data, and synchronously moving a carriage in the main scan direction.

Figure 1:
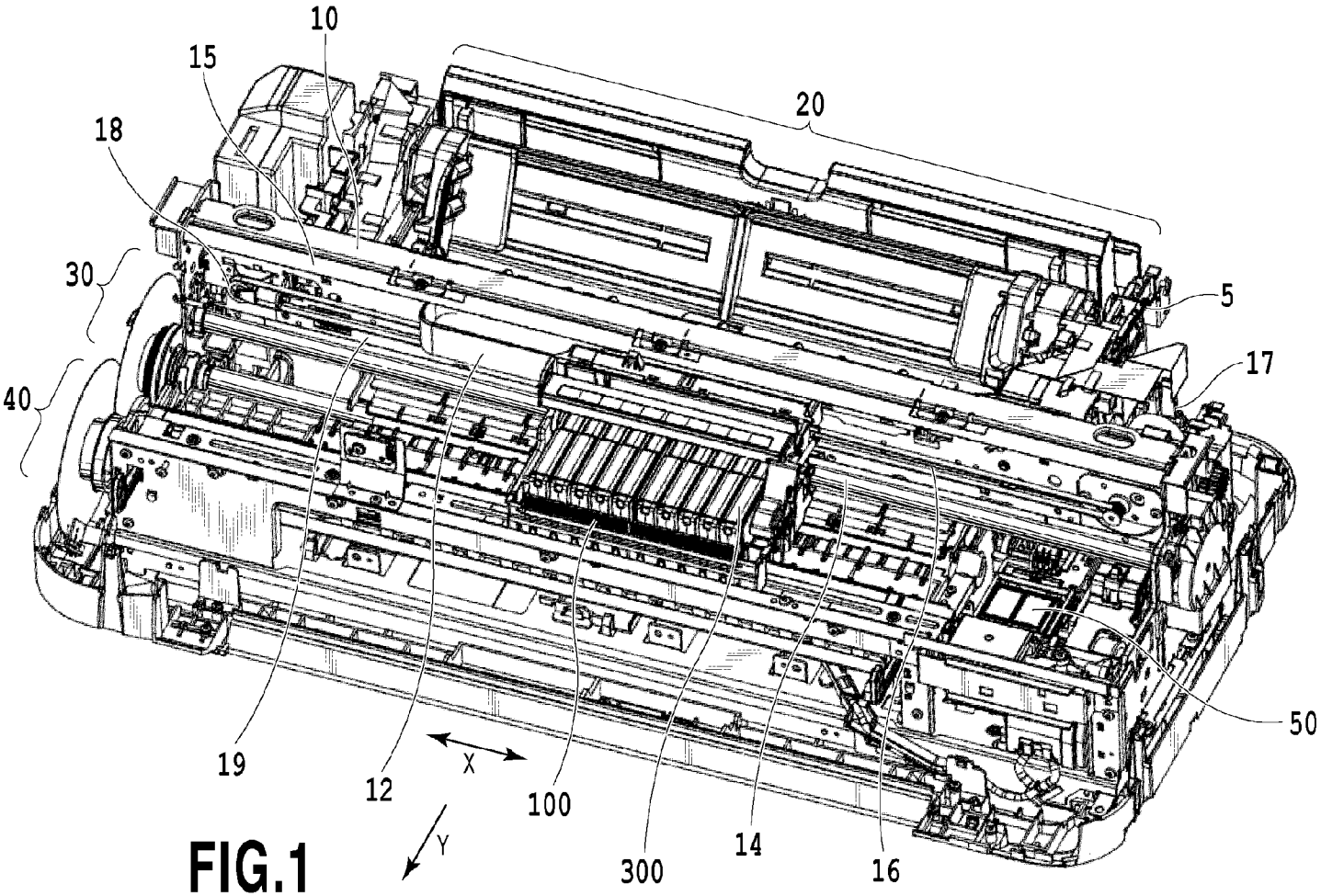
FIG. 1 is a perspective view of the general configuration of an ink jet printing apparatus according to a first embodiment of the present invention.

FIG. 1 is a perspective view of the entire printing apparatus. The printing apparatus of this embodiment roughly includes a sheet feeder (an ASF unit) 20, a printing medium conveying unit (a sheet conveying unit) 30, a sheet discharging unit 40, a print head recovery unit (a recovery unit) 50, a main scanning unit (a carrier unit) 100 on which a head cartridge 200 is mounted, and a controller for controlling these components. The head cartridge 200 includes, on the bottom, a print head for which ejection port groups in which ink ejection ports are arranged are prepared for the individual ink colors, and is detachably mounted on the carriage. Further, ink tanks to supply ink are also detachably mounted on the carriage.

Figure 3:
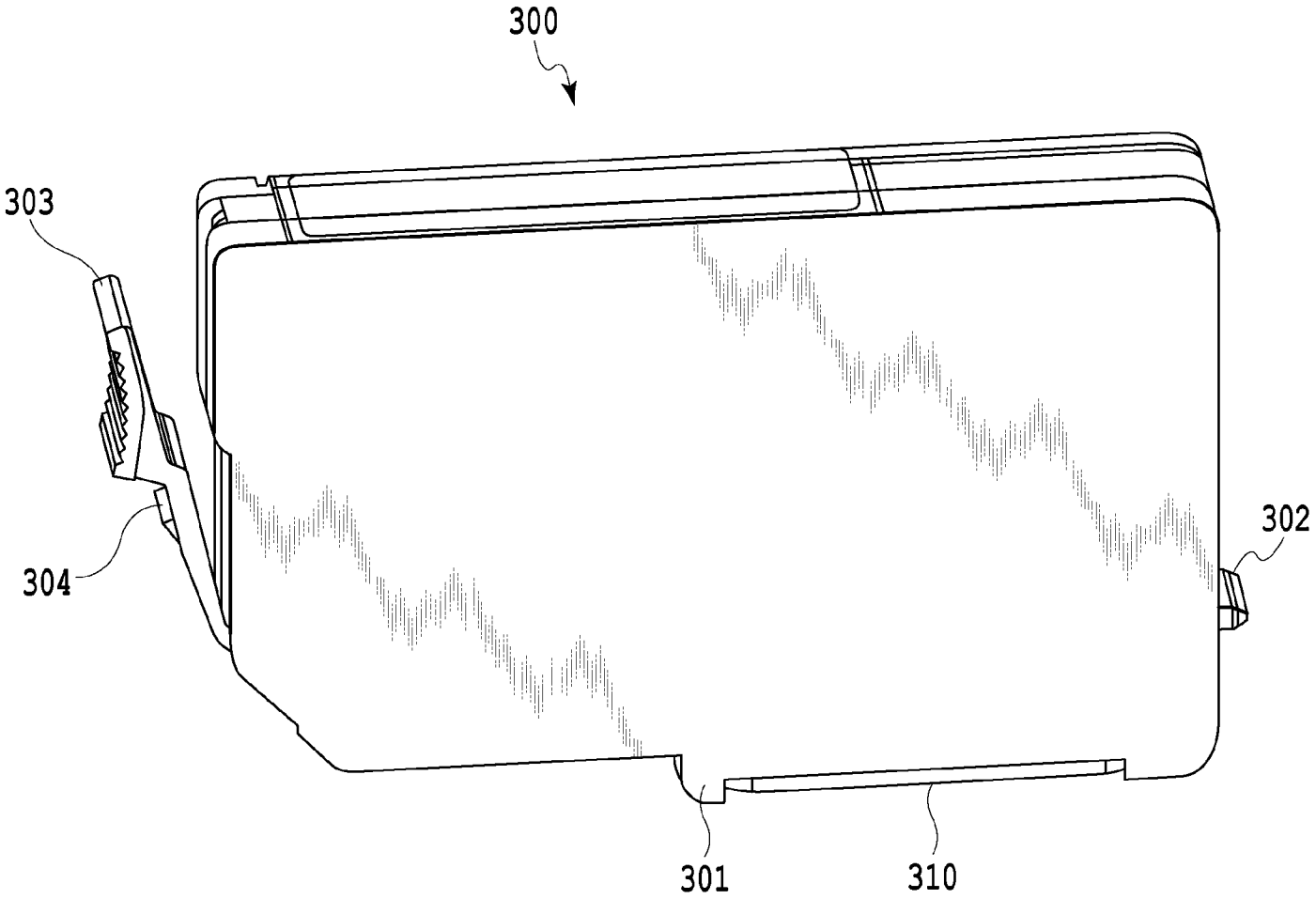
FIG. 3 is a perspective view of an ink tank for the first embodiment.
Figure 4:
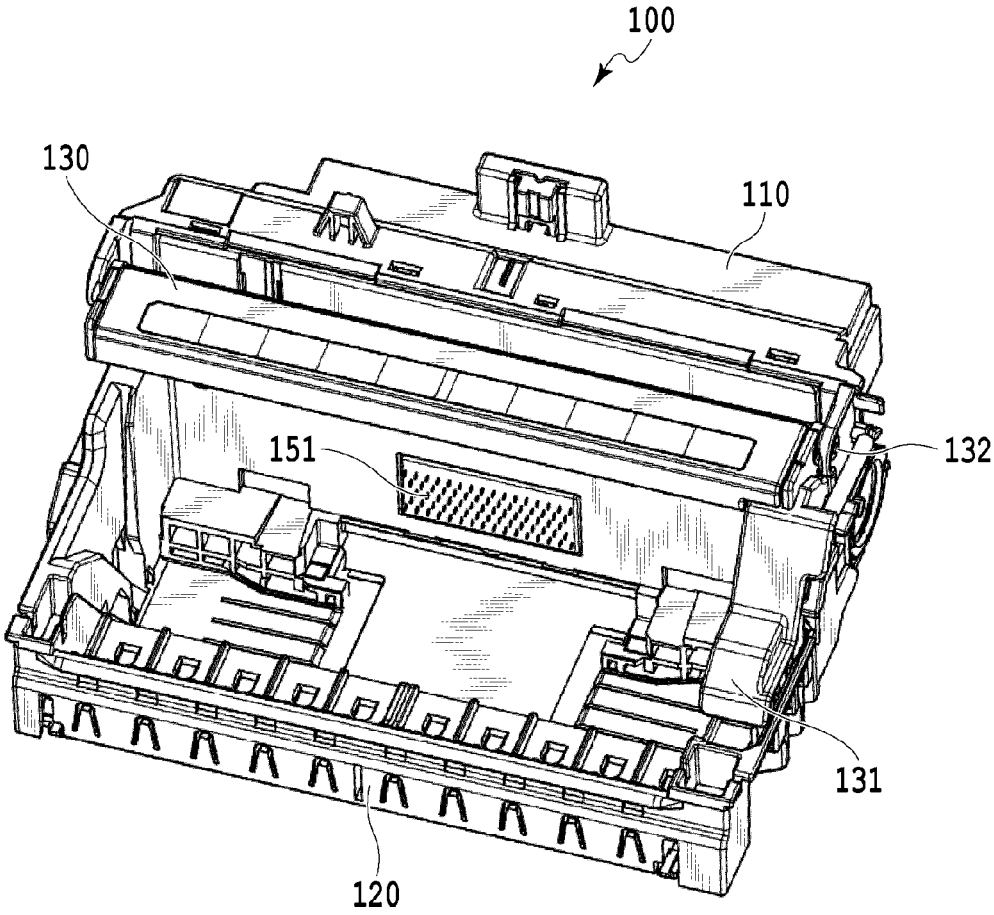
FIG. 4 is a perspective view of the structure of a main scanning unit according to the first embodiment.

Information, such as print data, is transmitted from a host apparatus (not shown) to the printing apparatus, and is stored into a controller (not shown) mounted on a control substrate 5, which is internally provided for the printing apparatus, and thereafter, a printing start instruction is issued by the controller to begin the printing operation. When the printing operation is initiated, a printing sheet is fed as a printing medium by the sheet feeder 20. Thereafter, the carrier unit 100, serving as the main scanning unit, moves in the main scanning direction (the X direction) (main scanning). For the individual main scanning movements, ink droplets are ejected from the individual nozzles of a print head 201 (see FIG. 2A) based on print data that is equivalent to the width of nozzle arrays (equivalent to one band) of each nozzle portion 201*a* formed in the print head 201. As shown in FIG. 4, the carrier unit 100 includes: a carriage 110 (see FIG. 5), on which the head cartridge 200 (see FIGS. 2A to 2C) that includes the print head 201 as printing unit, and ink tanks 300 (see FIG. 3) are mounted, and which is scanned in the main scanning direction X; and an tank holder 120 (see FIG. 6).

The carrier unit 100, serving as a main scanning unit, is guided and supported by a guide shaft 14, fixed to a chassis 10, and a support rail 15, fixed to the upper portion of the chassis 10. The carrier unit 100 is to reciprocally move (perform scanning) along the guide shaft 14 by receiving a drive force from a carriage motor 17 via a carriage belt 16, which is extended between the carriage motor 17 and an idler pulley 18. Further, as shown in FIG. 4, an insulation-displacement connector 151 is provided for the carrier unit 100 used to mount the head cartridge 200. The insulation-displacement connector 151, which is metal being plated, is to be pressed into the exposed conductive portion of the head cartridge 200 by elastically deforming the metal, and provides an electric connection with the contact face of the head cartridge 200, which will be described later. The insulation-displacement connector 151 is attached, by soldering, to a substrate (a carriage substrate) 150 mounted on the carriage 110. The carriage substrate 150 is electrically connected via a flexible flat cable (FFC) 12 to the controller of the control substrate 5 provided for the main body of the apparatus.

In the ink jet printing apparatus having the above described configuration, a signal from a head driver (not shown) is transmitted to the print head 201 via the FFC 12 to eject ink droplets based on print data. Further, an encoder strip 19, extended to the chassis 10, is read by a CR encoder (not shown) mounted on the carriage substrate 150 of the carriage 110, so that at appropriate timings, ink droplets can be ejected onto a printing sheet.

When printing for one band has been completed, the printing sheet is conveyed a required distance by the sheet conveying unit (the printing medium conveying unit) 30. When the printing operation of the head cartridge 200 (the main scanning) and the print sheet conveying operation are repeatedly performed, an image can be printed across the entire area of the printing sheet.

Figure 2A:
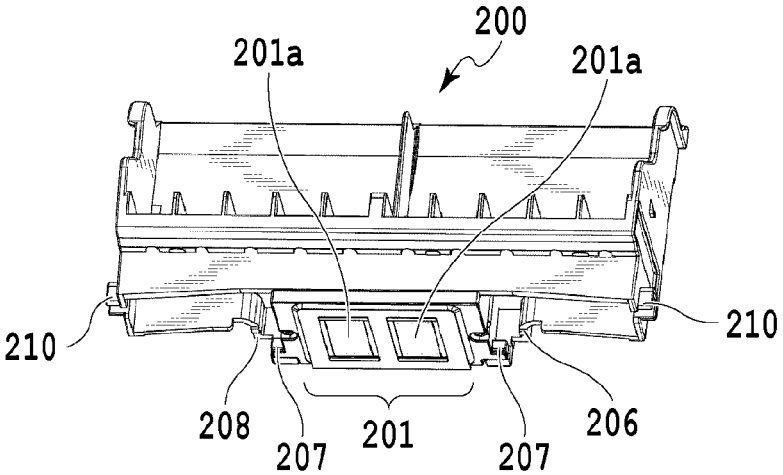
FIGS. 2A to 2C are diagrams showing a head cartridge for the first embodiment.
Figure 2B:
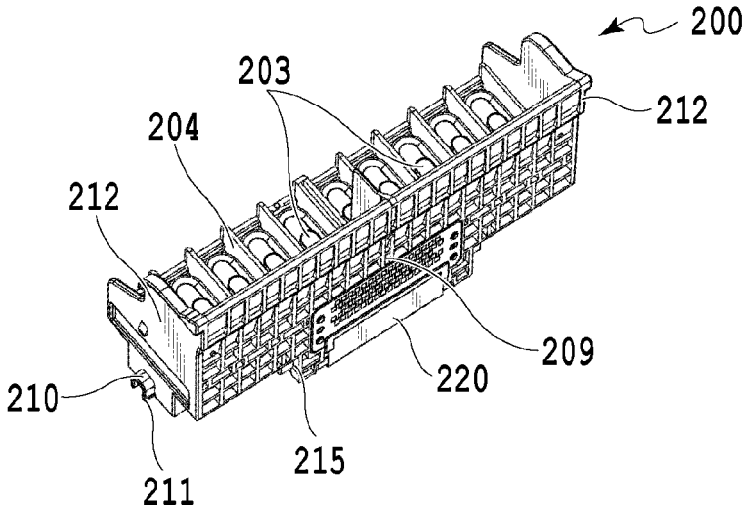
Figure 2C:
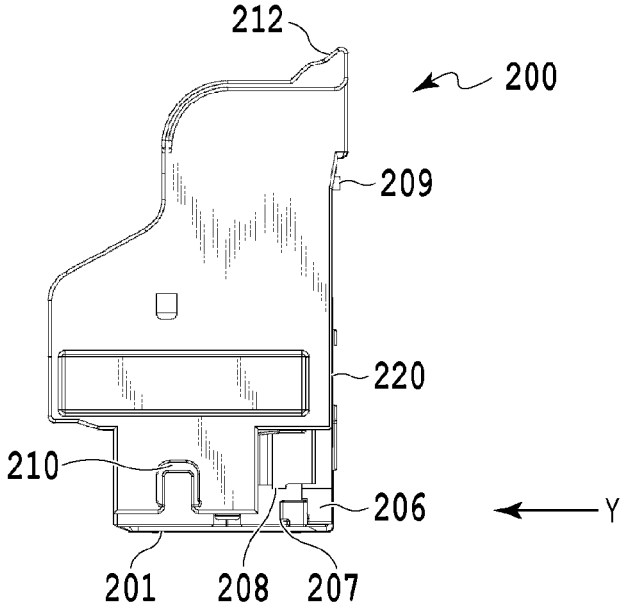

FIG. 2A is a perspective view, taken from the front obliquely downward, of the head cartridge 200 as printing unit, FIG. 2B is a perspective view, taken from the rear obliquely upward, of the head cartridge 200, and FIG. 2C is a side view of the head cartridge 200. FIG. 3 is a perspective view of an ink tank 300 employed as an ink storage portion. In this embodiment, the ink tanks 300 and the head cartridge 200 are separate units, and the ink tanks 300 are to be fitted to, and held by, the head cartridge 200 and the tank holder 120, so as to be detachable. The head cartridge 200 is to be securely attached to, or released from, the carrier unit 100 by operation of a head fixing lever 130 that will be described later.

As shown in FIGS. 2A to 2C, the print head 201 having the nozzle portions 201*a* is arranged on the lower face of the head cartridge 200, which is to be mounted on the carrier unit 100. The print head 201 includes ink inflow portions 203 that will communicate with ink supply ports (ink supplying portions) 310, which will be described later, when ink tanks 300 are mounted on the head cartridge 200. Ink flow paths (not shown) are formed from the ink inflow portions 203, and are extended to the print head 201. With this arrangement, ink stored in the ink tanks 300 is supplied to the nozzle portions 201*a* of the print head 201 of the head cartridge 200.

Moreover, a head substrate 220 used for an electrical connection is mounted on the reverse face of the head cartridge 200. The head substrate 220 includes an exposed conductive portion (hereinafter referred to as a contact face) on which there is no resist-coating. It should be noted here that 60 contacts, for example, are arranged on the contact face. The head cartridge 200 has the print head 201, which selectively ejects ink, from a plurality of ejection ports, upon application of electric energy based on a print signal, and thus performs printing.

Guide bosses 210 having symmetrical shapes are provided on the lower right and left sides of the head cartridge 200. When the head cartridge 200 is to be mounted on the carrier unit 100, the guide bosses 210 are guided along guide grooves 121A (see FIG. 6), which are formed on either side of the tank holder 120 employed as a tank holding member. Protrusions 211 (see FIGS. 2C and 10B) are formed at the lower ends of the guide bosses 210, and are to be pressed by the tank holder 120, in a manner that will be described later, when the ink tanks 300 have been mounted on the head cartridge 200 and the head cartridge 200 has been securely attached to the carrier unit 100 by operating the head fixing lever (the fixing member) 130.

An X-directional abutment surface 206 is provided on one side of the lower portion of the head cartridge 200, and is employed to position the head cartridge 200 in a location in the X direction, relative to the carriage 110. Further, on both sides of the lower portion of the head cartridge 200, a Y-directional abutment surface 207 and a Z-directional abutment surface 208 are provided to position the head cartridge 200 in the Y direction (the conveying direction) and in the Z direction (the vertical direction), respectively, while in contact with the carriage 110. Furthermore, in FIG. 2B, an abutment subsurface 209 is provided in the center of the reverse face of the head cartridge 200 to position the head cartridge 200 in the Y direction (the sheet conveying direction), when in contact with the carriage 110.

Moreover, pressure slopes 212 are formed at the upper portion of the head cartridge 200, and are to be held down by head fixing cams 135 that serve as cartridge fixing portions that will be described later. In other words, the pressure slopes 212 are the portions of the cartridge 200 that are to be pushed by the head fixing cams 135 attached to the carriage 110. When the head fixing cams 135 push the head carriage 200, the head cartridge 200 is fixed to the carriage 110 at a predetermined position.

FIG. 3 is a perspective view for explaining the ink tank 300. As shown in FIG. 3, a first pawl 302 is provided as a first engagement portion on one of the side faces of the ink tank 300, while a lever portion 303 having a second pawl 304 as a second engagement portion is provided on the other side face of the ink tank 300. The first pawl 302 is fitted into a pawl engagement hole 215 (see FIG. 8) formed in the head cartridge 200 when the ink tank 300 is mounted on the head cartridge 200. The second pawl 304 engages a pawl engagement portion 123 (see FIG. 6) of the tank holder 120 that is supported by the carriage 110. As a result, the ink tank 300 is fitted to, and held by, the head cartridge 200 that is mounted on the carrier unit 100.

As shown in FIG. 3, the ink supply port 310 that has a cylindrical shape is projected from the bottom of the ink tank 300. Further, a joint member (not shown) that contacts ink is provided inside the ink supply port 310. Further, as described above, the head cartridge 200 includes the ink inflow portions 203 that are positioned at locations corresponding to the individual ink supply ports 310 when the ink tanks 300 are mounted. Therefore, when the ink tanks 300 are mounted on the head cartridge 200, ink contained in the ink tanks 300 is supplied through the ink supply ports 310, via the joint members (not shown) to the nozzle portions 201*a* of the print head 201.

FIG. 4 is a perspective view of the structure of the essential portion of the main scanning unit (the carrier unit) 100 of the printing apparatus shown in FIG. 1, i.e., showing the state wherein the head cartridge 200 and the ink tanks 300 have not yet been mounted on the carrier unit 100. The carrier unit 100 includes the carriage 110 used for positioning the head cartridge 200. Further, the head fixing lever 130 is arranged on the upper face of the carriage 110, and holds down the pressure slopes 212, formed on the upper portion of the head cartridge 200, in order to securely hold the head cartridge 200. The head fixing lever 130 is to be pivoted, relative to the carriage 110, at lever rotation shafts 132 provided at both ends. Furthermore, the head fixing lever 130 includes a manipulation portion 131, to which a user applies a force to rotate the head fixing lever 130. Moreover, the head fixing lever 130 includes a plurality of head fixing cams 135 that are urged by head pressing springs 136. These head fixing cams 135 are to be pivoted, at the lever rotation shafts 132, with the rotation of the head fixing lever 130 at the shafts 132. When the head fixing lever 130 is closed by turning down the manipulation lever 131, the head fixing lever 130 contacts the pressure slopes 212 of the head cartridge 200 and applies a pressing force to securely hold down the head cartridge 200 in the carriage 110.

Figure 5:
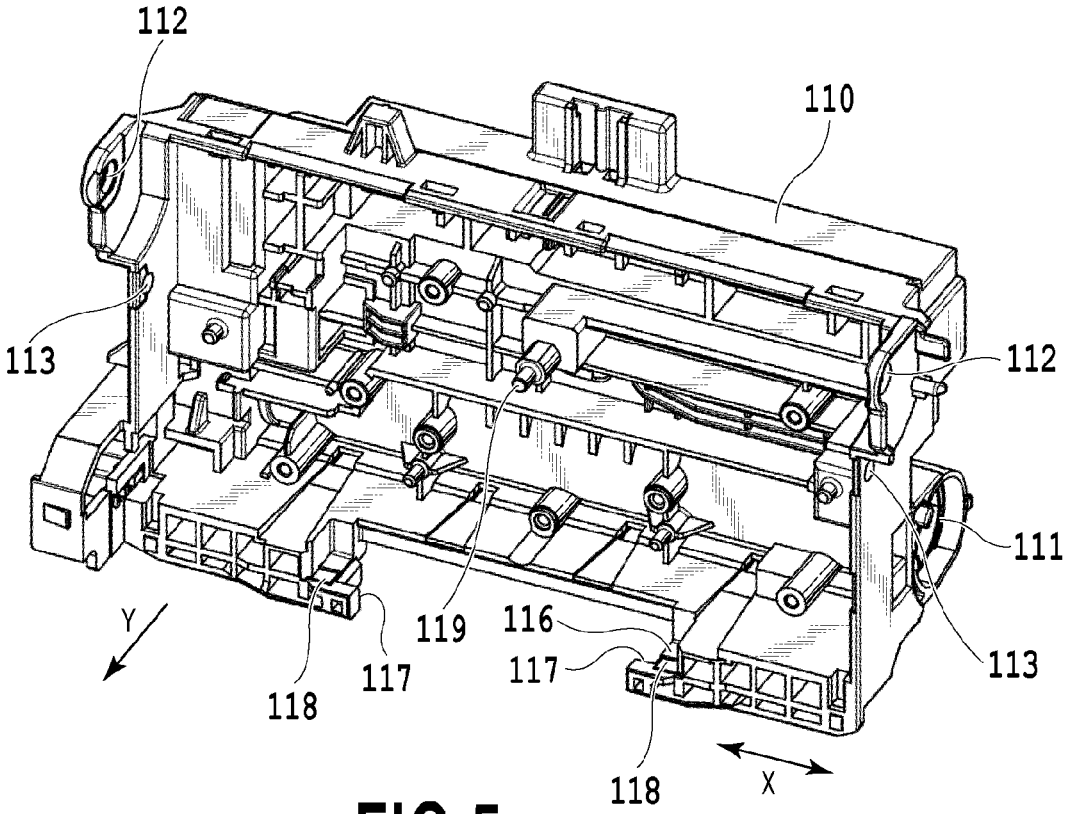
FIG. 5 is a perspective view of the structure of a carriage according to the first embodiment.

FIG. 5 is a perspective view of the detailed structure of the carriage 110 shown in FIG. 4. A Z-directional (vertical directional) locating surface 118, provided on the lower portion of the carriage 110, is to be pressed against the Z-directional abutment surface 208 at the lower portion of the head cartridge 200. Further, a Y-directional (conveying directional) locating surface 117, provided near the Z-directional locating surface 118, is a face to be pressed against the Y-directional abutment surface 207 of the head cartridge 200. Moreover, a Y-directional locating subsurface 119, at the tip of a projection formed near the center of the carriage 110, is a face to be pressed against the Y-directional abutment subsurface 209 of the upper portion of the head cartridge 200. Further, an X-directional (main scanning directional) locating surface 116, provided for the carriage 110, is a face to be pressed against the X-directional abutment surface 206 of the head cartridge 200.

Holes 112 are formed in the respective right and left upper portions of the carriage 110, and are employed as cover rotation holes 112 for rotatably supporting the right and left lever rotation shafts 132 (see FIG. 4) of the head fixing lever 130. Holes 113 are formed in the centers of the right and left side portions of the carriage 110, and are employed as holder mounting holes, along which right and left tank holder support shafts 125 for the tank holder 120 are to be inserted to support the tank holder 120, on the carriage 110, so swingable.

The tank holder 120 that is fitted to the carriage 110 as a tank holding member will now be described in detail.

Figure 6:
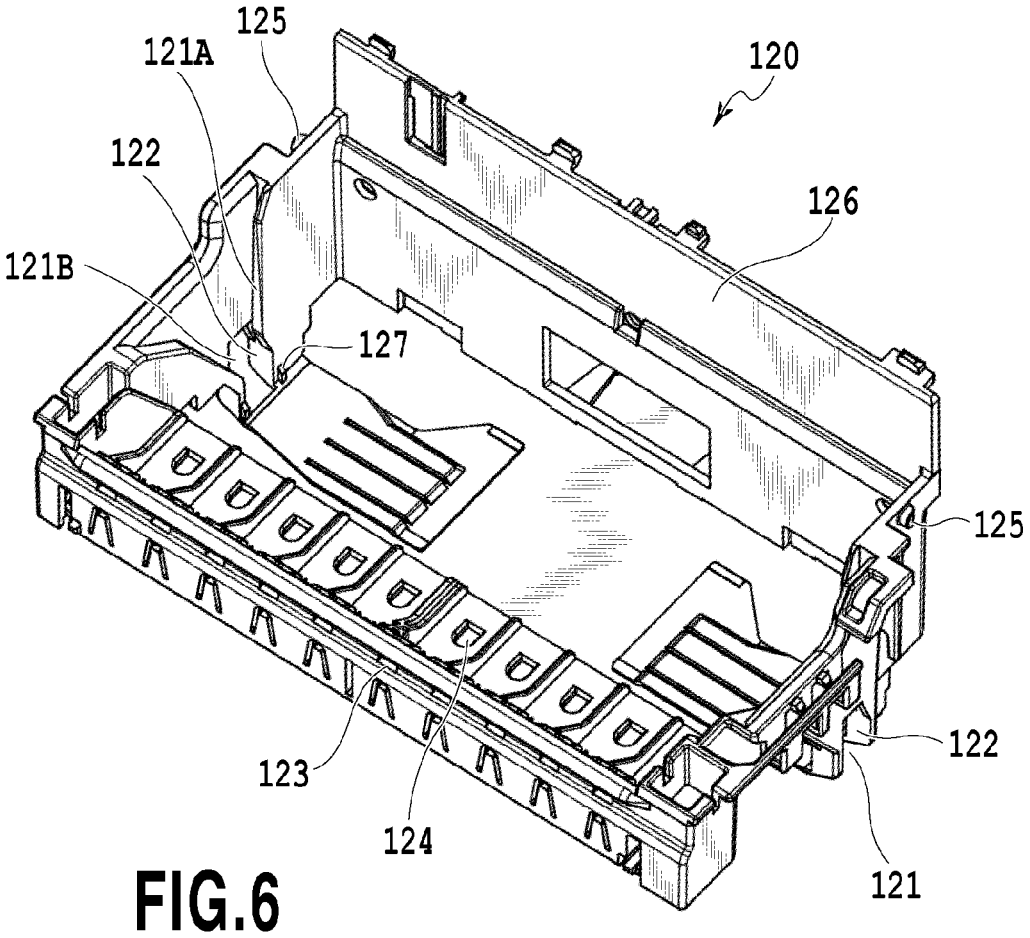
FIG. 6 is a perspective view of the structure of a tank holder to be mounted on the carriage of the first embodiment.

FIG. 6 is a perspective view of the tank holder 120 to be mounted on the carriage 110 in FIG. 4. In FIG. 6, the guide grooves 121A and engagement grooves 121B are formed on both right and left side portions of the tank holder 120, so that the guide bosses 210, formed on the right and left side portions of the head cartridge 200, are to be guided downward along the guide grooves 121A and fitted into the engagement grooves 121B. Further, the tank holder support shafts 125 are formed on both side portions of the tank holder 120, and when the tank holder support shafts 125 are fitted into the holder mounting holes 113 on both sides of the carriage 110, the tank holder 120 can be supported by the carriage 110. A wall portion 126 is integrally formed with the tank holder 120 to shield and protect the carriage substrate 150, the FFC 12 and the head substrate 220. Furthermore, the pawl engagement portions 123 are formed for the tank holder 120 to engage the second pawls 304 when the ink tanks 300 are mounted. Moreover, locating holes 124 are formed in the bottom of the tank holder 120 that fit locating pins on the ink tanks 300.

Flexible ribs 127 are integrally formed on one side at the lower portion of the tank holder 120, and are employed to push the head cartridge 200 in one of the directions along the X axis (either main scanning direction) when the tank holder 120 is mounted on the head cartridge 200.

Figure 7:
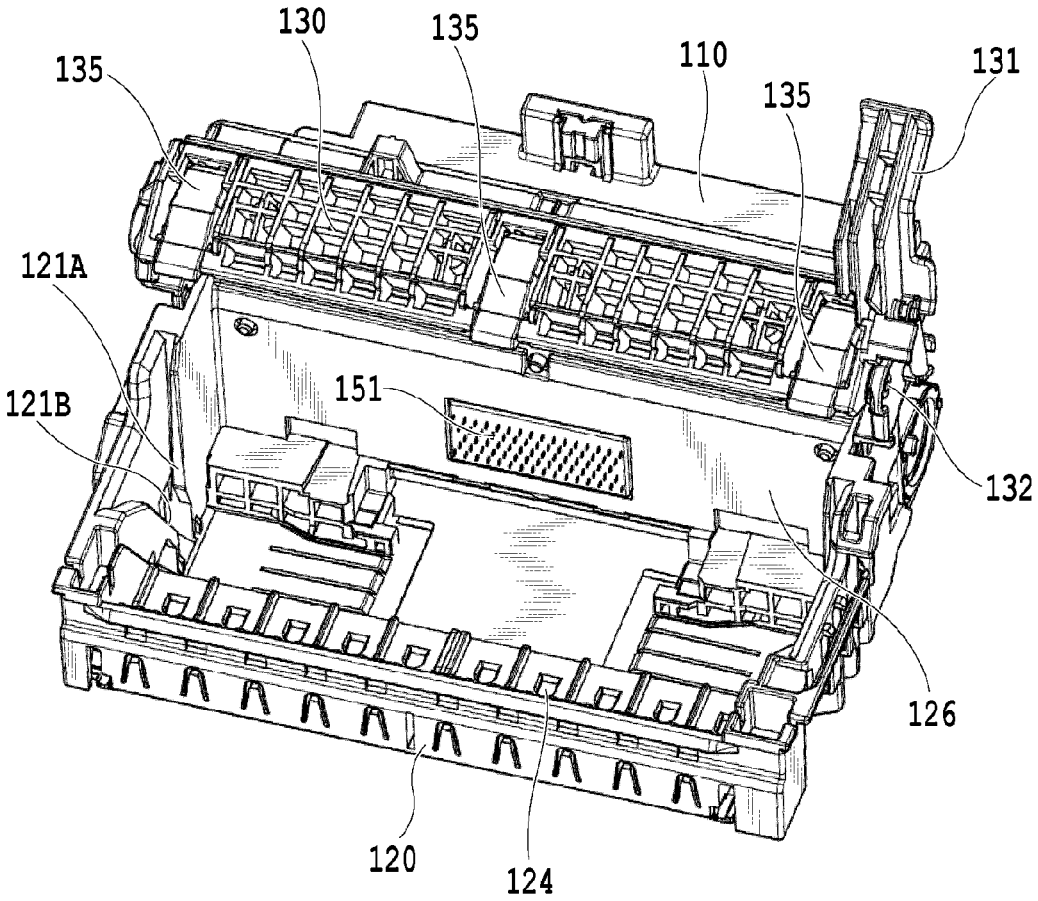
FIG. 7 is a perspective view of the unlocked state of a head fixing lever provided for the main scanning unit according to the first embodiment.
Figure 8:
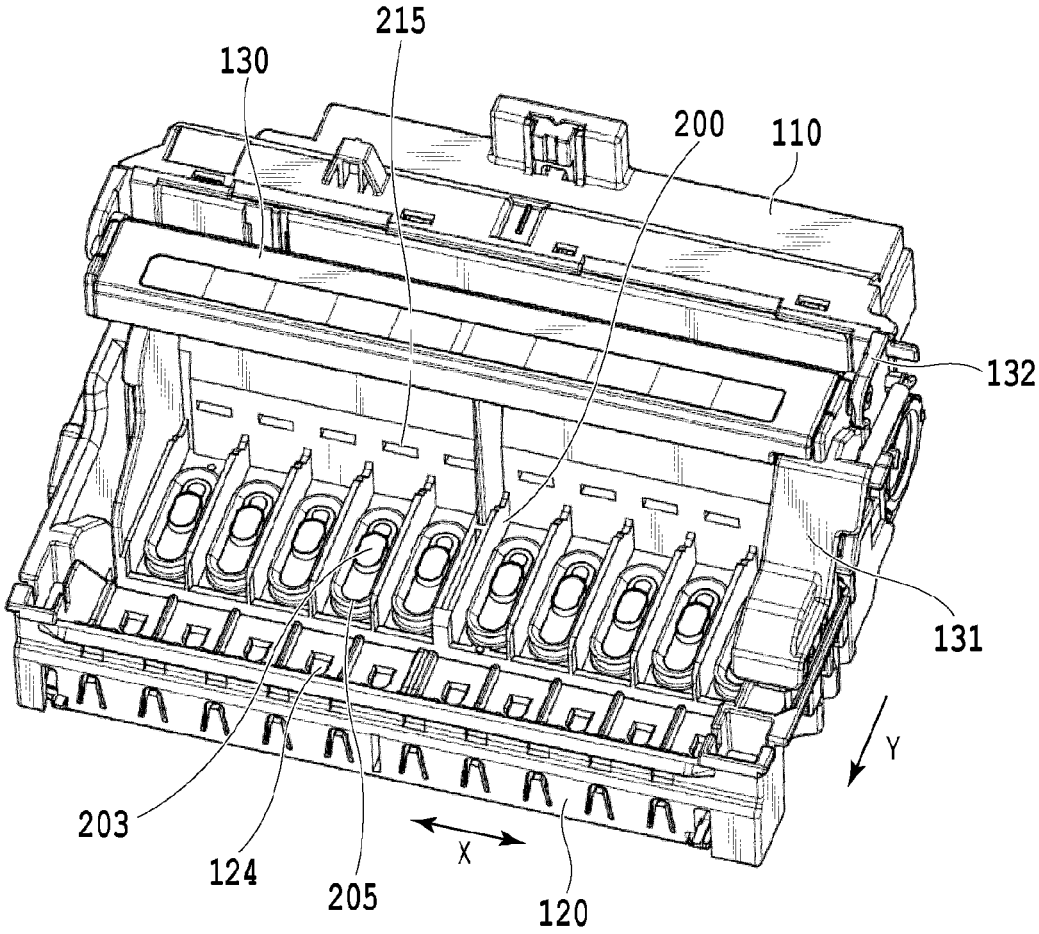
FIG. 8 is a perspective view of the state wherein a head cartridge is mounted on the main scanning unit according to the first embodiment.
Figure 9:
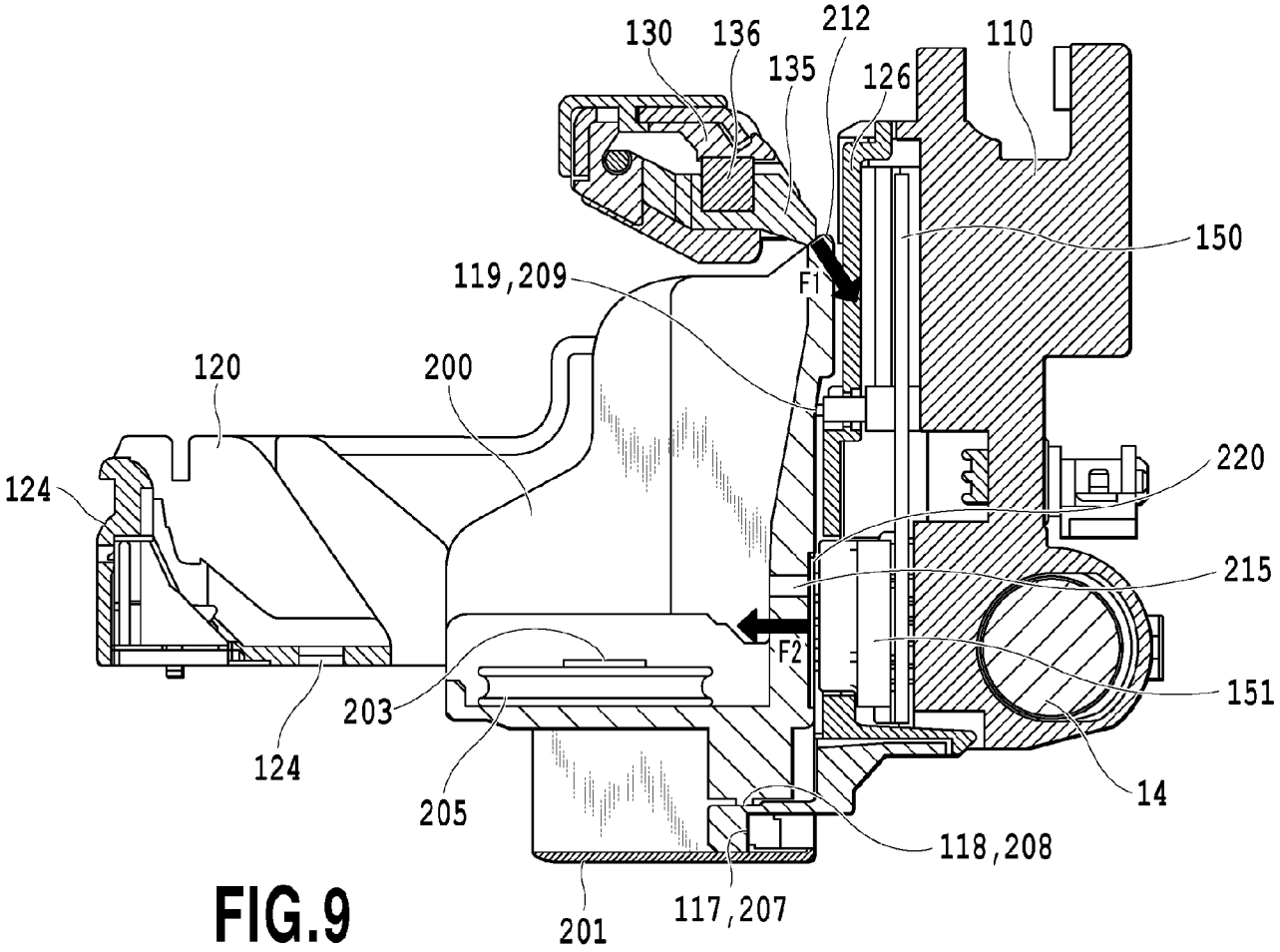
FIG. 9 is a cross sectional view of the assembly shown in FIG. 8.
Figure 10A:
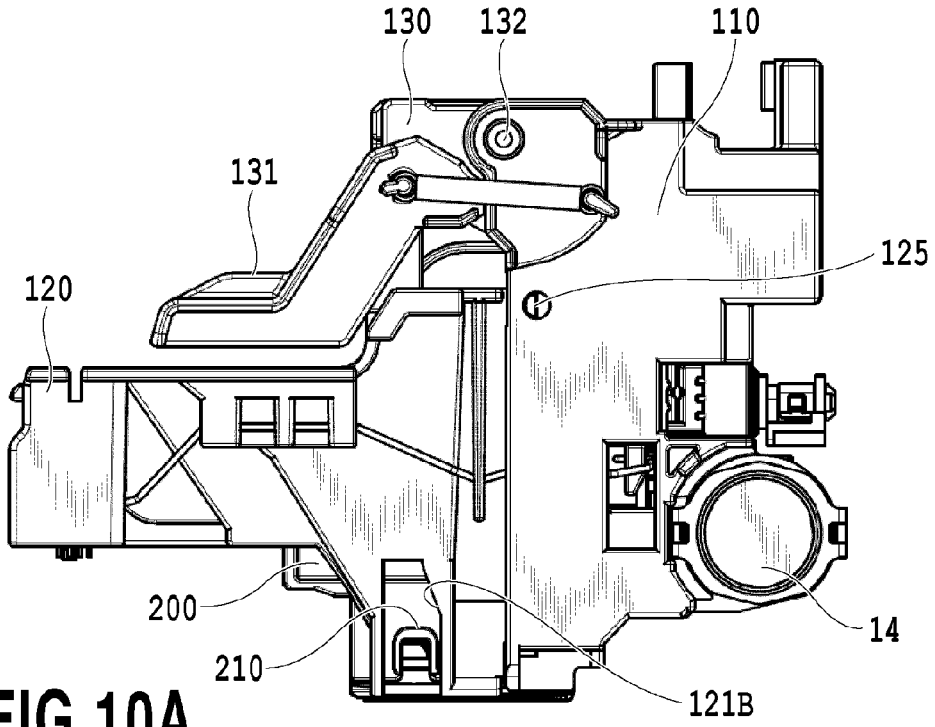
FIG. 10A is a side view of the assembly shown in FIG. 8.

The operation performed to mount the head cartridge 200 and the ink tanks 300 on the above described carrier unit 100 will now be described while referring to FIG. 7 to FIGS. 13A and 13B. FIG. 7 is a perspective view of the state wherein the head fixing lever 130 is retracted upward immediately before the head cartridge 200 is inserted into the carrier unit 100. FIG. 8 is a perspective view of the state wherein only the head cartridge 200 has been inserted into the carrier unit 100, and the head fixing lever 130 is turned to set the head carriage 200 on the carriage 10 in the mounting position. FIG. 9 is a schematic cross-sectional view of the structure in FIG. 8. FIG. 10A is a side view of the state wherein the head cartridge 200 in the state in FIG. 8 is set for the mounting position of the carriage 110.

As shown in FIG. 7, first, a user turns the fixing lever 130 upward, and in the state shown in FIG. 7, inserts the head cartridge 200. To insert the head cartridge 200, the guide bosses 210 on the right and left sides of the head cartridge 200 slide down along the guide grooves 121A on the right and left sides of the tank holder 120 until the guide bosses 210 reach the engagement grooves 121B. At this time, a gap is formed between the engagement grooves 121B and the guide bosses 210, so that the guide bosses 210 are movable within the engagement grooves 121B. Thereafter, when the head fixing lever 130 starts pivoting by pushing down the fixing lever 130, the head fixing cams 135 contact the pressure slopes 212 of the head cartridge 200, and begin to press the head cartridge 200 down. At this time, the head cartridge 200 begins to pivot at the guide bosses 210.

When the head fixing lever 131 has been pushed down completely, as shown in FIG. 8, the abutment surfaces 206 to 209 of the head cartridge 200 meet the locating surfaces 116 to 119 of the carriage 110. In the state, as shown in FIG. 9, wherein only the head cartridge 200 has been mounted, i.e., wherein the ink tanks 300 have not yet been mounted, the head cartridge 200 receives an external force F1 from the head fixing cams 135, and also receives a repulsive force F2 from the insulation-displacement connector 151. The operating directions for the external forces F1 and F2 are those substantially indicated by respective arrows in FIG. 9.

Because of the external forces F1 and F2, the abutment surfaces 206 to 209 of the head cartridge 200 are pressed against the locating surfaces (or the abutment surfaces) 116 to 119 of the carriage 110, so that the head cartridge 200 is positioned in a location relative to the carriage 110. That is, the head cartridge 200 is positioned in the Y direction (the conveying direction) by the abutment surface 207 meeting the locating surface 117 of the carriage 110 and the abutment subsurface 209 meeting the locating subsurface 119 of the carriage 110. Further, the head cartridge 200 is positioned in the Z direction (the vertical direction) by the Z-directional abutment surface 208 meeting the carriage surface 108. Furthermore, for the X direction (the main scanning direction), the head cartridge 200 is positioned by being pressed against the flexible ribs 127 of the tank holder 120 in a direction parallel to the X direction. That is, when the abutment surface 206 formed on one side of the head cartridge 200 meets the surface 116 of the carriage 110, the head cartridge 200 is positioned in the X direction.

Figure 10B:
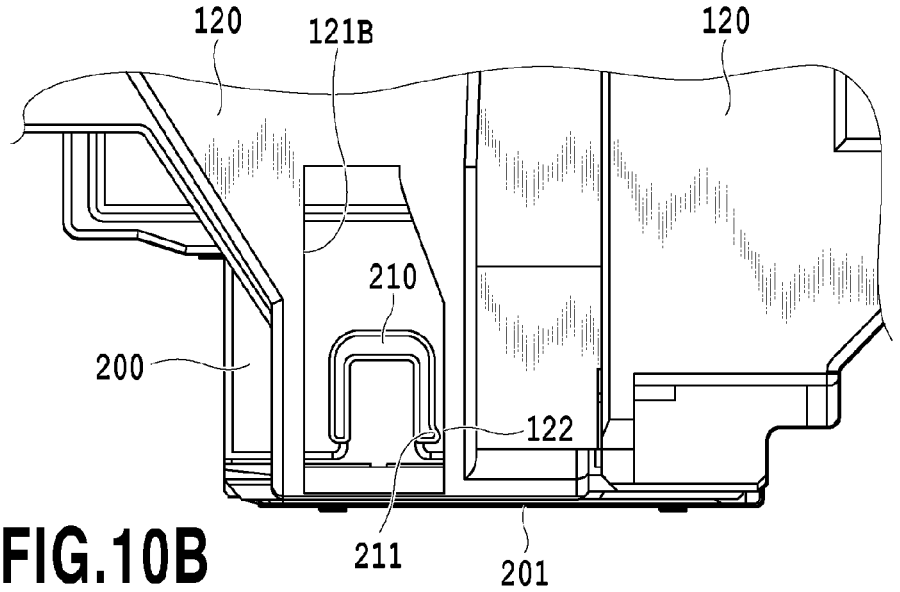
FIG. 10B is an enlarged diagram showing the guide boss periphery of the assembly shown in FIG. 10A.

FIG. 10A is a side view of the state shown in FIGS. 8 and 9 wherein the head cartridge 200 has been mounted on the carriage 110, and FIG. 10B is an enlarged diagram showing the peripheral structure of the guide bosses 210 in FIG. 10A. As shown in these diagrams, in the state wherein only the head cartridge 200 has been mounted and securely set on the carriage 110, the guide bosses 210 provided for the right and left sides of the head cartridge 200 are set free, with respect to the engagement grooves 121B of the tank holder 120, i.e., the guide bosses 210 do not touch the inner faces of the engagement grooves 121B. This occurs because, as described above, the abutment surfaces 206 to 209 of the head cartridge 200 should appropriately meet the locating surfaces 116 to 119 of the carriage 110. In other words, this is because, if the guide bosses 210 of the head cartridge 200 and the engagement grooves 121B of the tank holder 120 contact and interfere with each other, the process performed to establish contact between the Y-directional abutment surface 207 of the head cartridge 200 and the Y-locating surface 117 of the carriage 110 will not be successful. In the state wherein the ink tanks 300 have not yet been mounted, the head cartridge 200 is positioned and fixed to the carriage 110 in the above described manner, as shown in FIGS. 8 to 10A.

Figure 11:
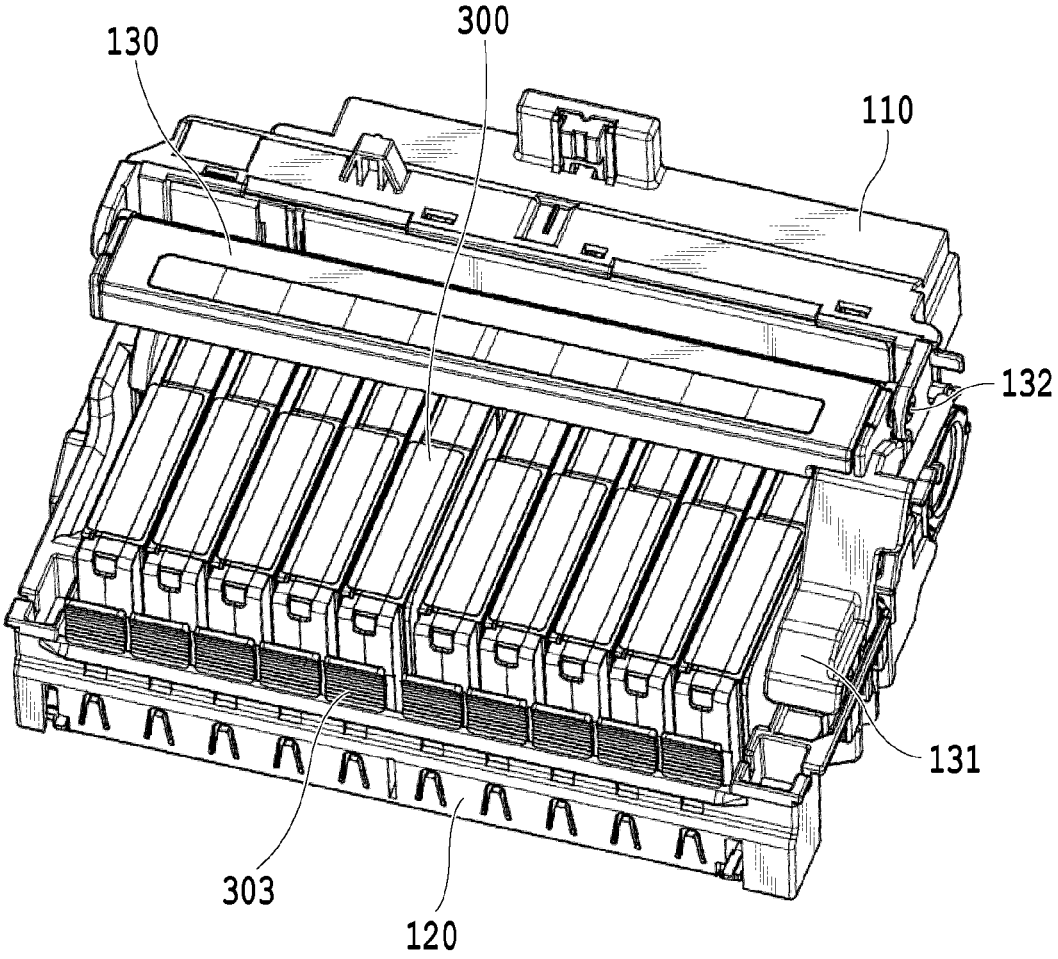
FIG. 11 is a perspective view of the state wherein ink tanks are mounted on the assembly shown in FIG. 10A.
Figure 12:
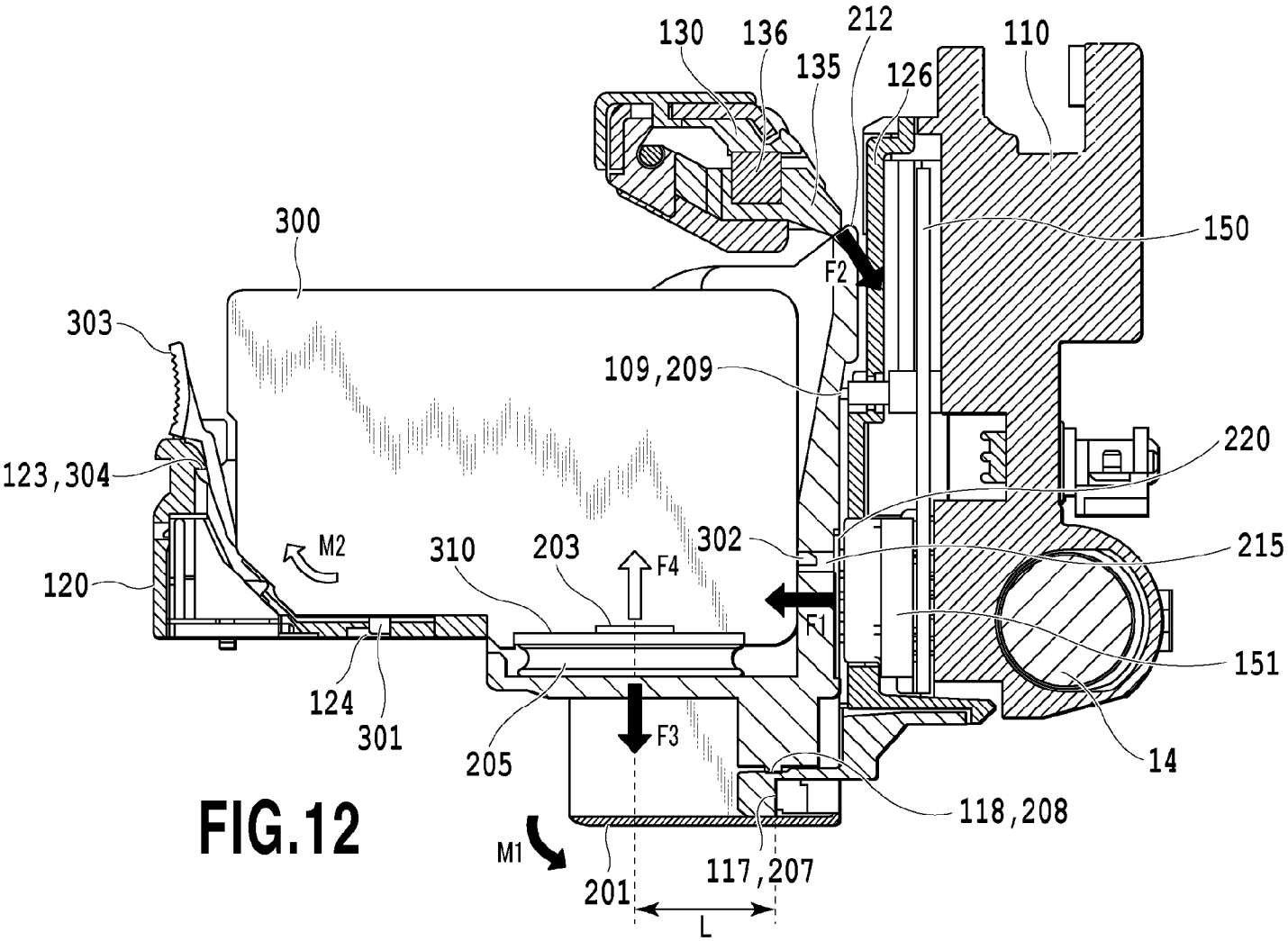
FIG. 12 is a schematic cross sectional view of the state for the first embodiment wherein a force is applied to the individual sections when ink tanks are fixed to a head cartridge and a tank holder.

A case wherein the ink tanks 300 are to be attached to the head cartridge 200 mounted on the carriage 110 will now be described while referring to FIG. 11 and to FIGS. 13A and 13B. FIG. 11 is a perspective view of the state wherein ink tanks 300 have been mounted in all the ink tank mounting portions of the head cartridge 200 attached to the carriage 110. In this embodiment, ten ink tanks 300 are mounted. To mount the ink tanks 300, the fixing lever 130 is turned upward (released), and the ink tanks 300 are inserted, with the ink support ports 310 facing the ink inflow portions 203, and with the first pawls 302 being inclined downward. First, the first pawls 302 of the ink tanks 300 are fitted into the pawl engagement holes 215 of the head cartridge 200. Following this, the tank levers 303 of the ink tanks 300 are pushed into the tank holder 120, and are temporarily deflected inside, and a restoring force exerted by the tank levers 303 is employed to fit the second pawls 304 into the holes 123 of the tank holder 120. At this time, locating pins 301 provided for the bottoms of the ink tanks 300 are fitted into the tank locating holes 124 of the tank holder 120, as shown in FIG. 12. In this manner, the ink tanks 300 are fixed to the head cartridge 200 and the tank holder 120. Thereafter, when the head fixing lever 130 is pivoted to securely mount the head cartridge 200 on the carriage 110, the ink tanks 300 are fixed to the head cartridge 200 and the tank holder 120.

FIG. 12 is a schematic cross-sectional view of forces that are exerted against the individual sections in the state wherein the ink tanks 300 are securely mounted on the head cartridge 200 and the tank holder 120. As shown in FIG. 12, when the ink tanks 300 have been mounted on the head cartridge 200, the joint members of the ink supply ports 310 and the rubber seal portions 205 contact each other closely at the ink inflow portions 203, and therefore, a repulsive force F3 is generated and applied to the head cartridge 200. The repulsive force F3, at close contact, is substantially a downward force, as indicated by an arrow in FIG. 12. At this time, the head cartridge 200 is positioned by pressing the Z-directional abutment surface 208 against the Z-directional locating surface 118 of the carriage 110. However, the Z-directional abutment surface 208 and the Z-directional locating surface 118 are located at a distance L from the center of each ink inflow portion 203 at which the repulsive force F3 is generated. Therefore, the repulsive force F3 is applied as a rotational force, as indicated by an arrow M1 in FIG. 12, by employing the edges of the Z-directional locating surfaces 118 as the rotational center.

The rotational force M1 acts to reduce the force exerted to press the Z-directional abutment surface 208 of the head cartridge 200 against the Z-directional locating surface 118 of the carriage 110, and also acts to reduce the force exerted to press the Y-abutment surface 207 of the head cartridge against the Y-locating surface 117 of the carriage 110, and the force exerted to press the abutment subsurface 209 of the head cartridge 200 against the locating subsurface 119 of the carriage 110. This rotational force M1 generated by the repulsive force F3 is to be exerted for the individual ink tanks 300 mounted to the head cartridge 200. Therefore, when more ink tanks 300 are mounted on the head cartridge 200, the sum of the rotational forces M1 is increased. Thus, depending on the number of ink tanks that are mounted, the total rotational force M1 may be greater than the force exerted to press the individual abutment surfaces of the head cartridge 200 against the corresponding locating surfaces of the carriage 110. In such a case, if a gap is present between the abutment surfaces 207 to 209 of the head cartridge 200 and the locating surfaces 117 to 119 of the carriage 110, the head cartridge 200 might not be held and fixed at an appropriate position, relative to the carriage 110. That is, the nozzle portions 201*a* of the print head 201, provided for the head cartridge 200, would be shifted to cause adverse effects for printing of an image. However, in this embodiment, the position shift of the head cartridge 200 described above can be prevented by the above action of the ink tank holder 120.

Specifically, when the rotational force M1 is generated by mounting the ink tanks 300, the repulsive force F4 in the reverse direction, equivalent to the force F3, is applied to the ink tanks 300. Since the first pawls 302 of the ink tanks 300 are fitted directly into the pawl engagement holes 215 formed in the head cartridge 200, the repulsive force F4 acts as a rotational force, as indicated by an arrow M2 in FIG. 12, by employing the first pawls 302 as the center. Furthermore, since the second pawls 304 of the ink tanks 300 are fitted into the pawl engagement portions 123 of the tank holder 120, the tank holder 120 receives the rotational force in a direction indicated by the arrow M2 in FIG. 12, and is moved in association with the ink tanks 300. That is, since the tank holder 120 is swingably supported by the holder mounting holes 113 that are formed on the right and left sides of the carriage 110, the tank holder 120 is pushed by the second pawls 304 when the ink tanks 300 are turned in the direction indicated by the arrow M2, and is pivoted at the shaft supported by the carriage 110.

Figure 13A:
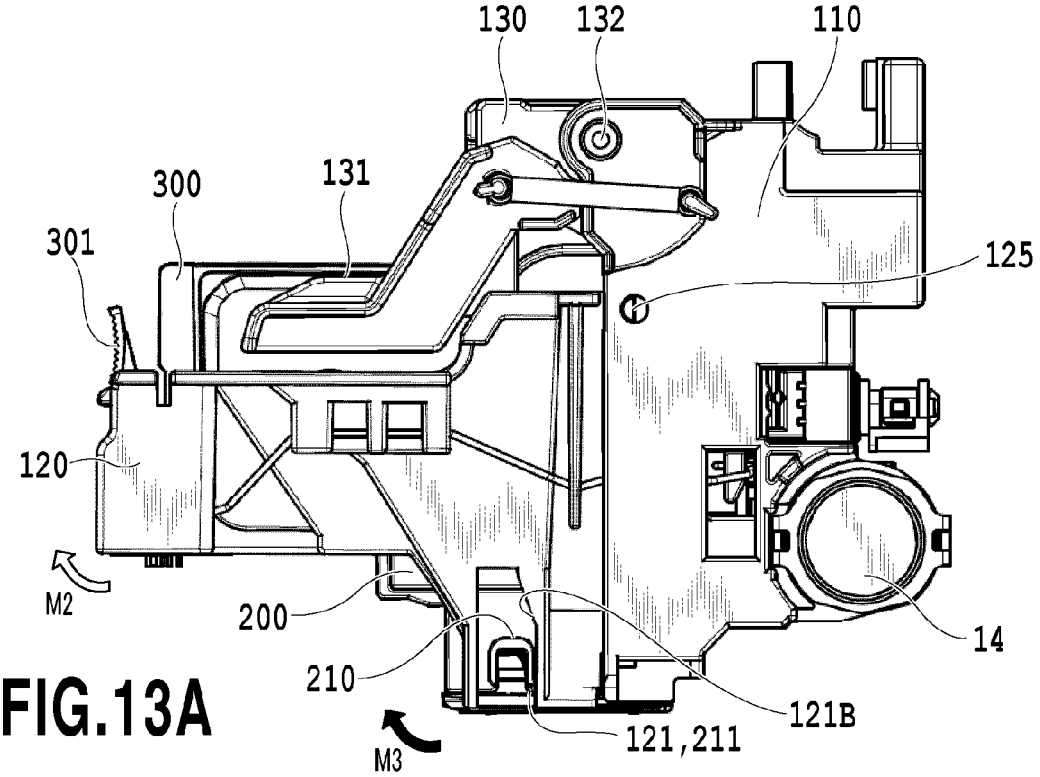
FIG. 13A is a side view of the state wherein ink tanks are mounted according to the first embodiment.

As well as FIGS. 11 and 12, FIG. 13A is a side view of the state wherein the ink tanks 300 are attached to the head cartridge 200 mounted on the carriage 110. FIG. 13B is an enlarged diagram showing the periphery of the guide boss 210 shown in FIG. 13A. As described above, the tank holder 120 is rotated in association with the ink tanks 300 by the rotational force M2 that is exerted by application of the repulsive force F4 to the ink tanks 300. Then, as shown in FIG. 13B, the inner faces of rough guide holding portions 122 of the engagement grooves 121B of the tank holder 120 contact the guide boss protrusions 211 of the head cartridge 200, and a contact force F5 is exerted against the head cartridge 200.

Figure 13B:
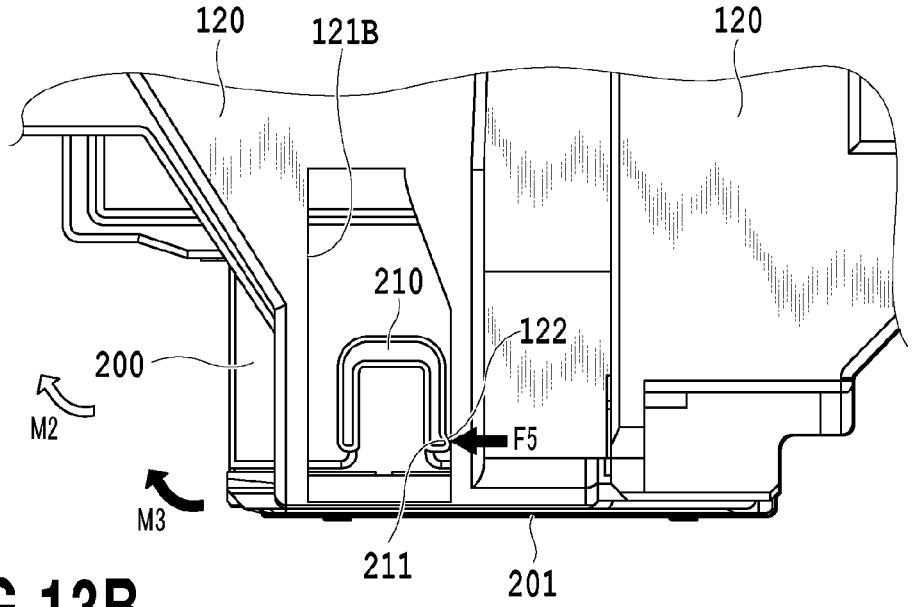
FIG. 13B is an enlarged diagram illustrating the guide boss periphery of the assembly shown in FIG. 13A.

The contact force F5 acts as a rotational force that is applied to the guide bosses 210 of the head cartridge 200 in a direction indicated by the arrow M3 in FIG. 13B. The rotational force in the direction M3 acts as a force that cancels the rotational force (in FIG. 12, the rotational force in the direction indicated by the arrow M1) that reduces the force that is exerted to press the abutment surfaces of the head cartridge 200 against those of the carriage 110. Therefore, the head cartridge 200 will not be rotated in the direction indicated by the arrow M1, and a gap will not be formed between the abutment surfaces 206 to 209 of the head cartridge 200 and the locating surfaces 116 to 119 of the carriage 110. As a result, the head cartridge 200 is fixed at an appropriate location, relative to the carriage 110.

The general relationship of the above described forces exerted against the carriage 110, the head cartridge 200 and the ink tanks 300 will be described as follows. The repulsive forces F3 and F4 are generated by close contact of the head cartridge 200 and the ink tanks 300. The repulsive force F3 acts as a force to reduce another force that is exerted to press the individual abutment surfaces of the head cartridge 200 against the locating surfaces of the carriage 110. The other repulsive force F4, generated at the same time as the repulsive force F3, acts as a rotational force that is generated for the ink tanks 300 to pivot, relative to the tank holder 120, by employing the support shaft 125 as the center. When the rotational force is applied to the tank holder 120, the inner faces of the rough guide holding portions 122 contact the guide boss protrusions 211 of the head cartridge 200, and therefore, the rotational force applied in a direction in which the head cartridge 200 is to be separated from the carriage 110 is canceled.

As described above, according to this embodiment, the repulsive force generated at the joint portions of the ink tanks and the rotational force applied to the head cartridge offset each other. Therefore, even when the number of ink tanks to be mounted on the head cartridge 200 is varied, the balance of the rotational forces exerted against the head cartridge will not be lost, and the head cartridge can be stably held at the appropriate location. Furthermore, even when the number of ink tanks is increased to provide higher image quality, a structure for increasing the force to hold the components in place is not especially required, and an increase in the manufacturing cost does not occur.

Second Embodiment

A second embodiment of the present invention will now be described while referring to FIG. 14.

In the second embodiment, a tank holder that is mounted on a carriage 110 as a tank holding member is different from that in the first embodiment. Since the other structure is the same as that for the first embodiment, the same reference numerals are provided for the corresponding portions, and no further description for them will be given.

Figure 14:
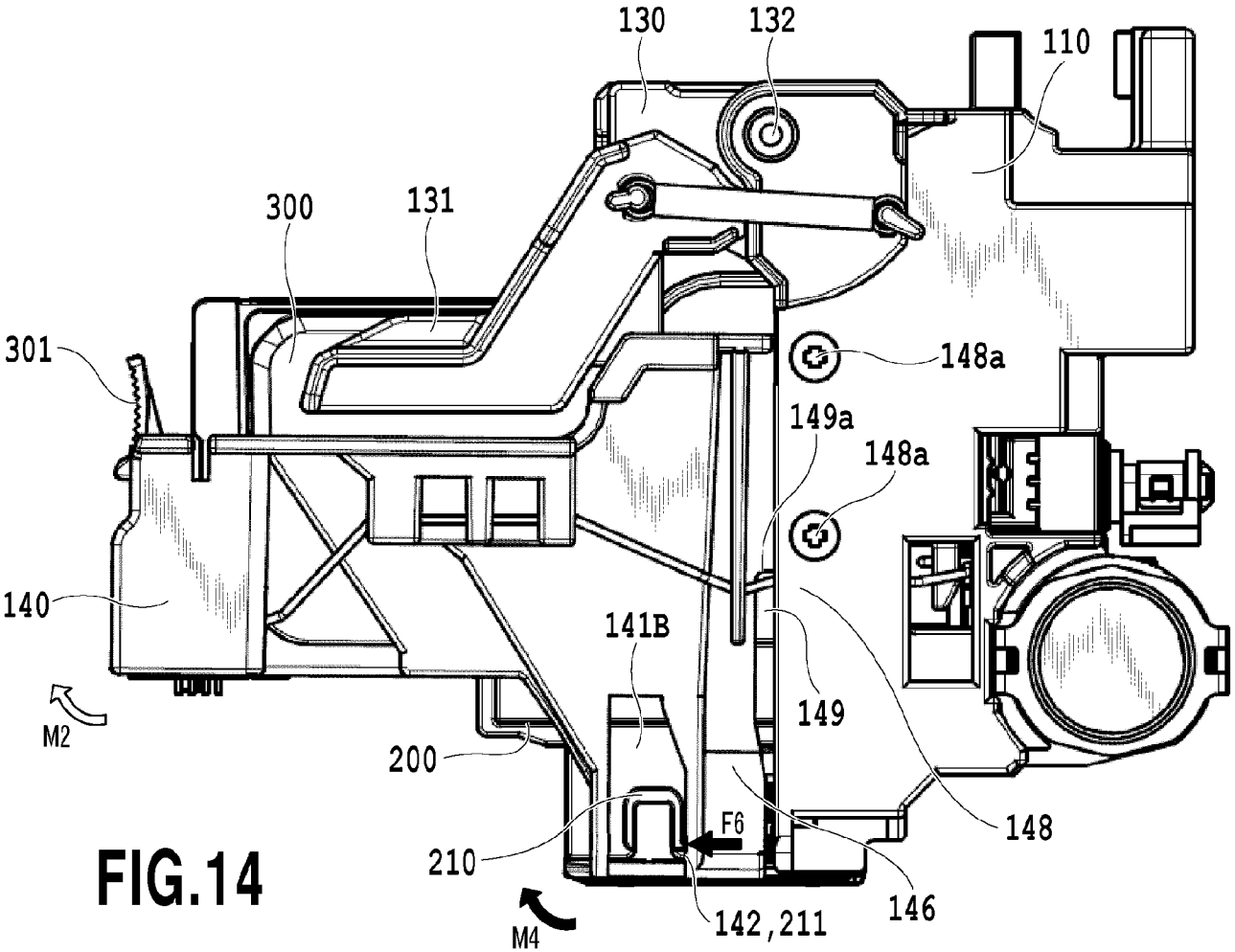
FIG. 14 is a side view of the state according to a second embodiment of the present invention wherein ink tanks are fixed to a head cartridge and a tank holder.

FIG. 14 is a side view of an arrangement that includes a tank holder 140 mounted on the carriage 110. In FIG. 14, guide grooves, which include those for the first embodiment, and engagement grooves 141B are formed on both sides of the tank holder 140, so that guide bosses 210 formed on the right and left sides of a head cartridge 200 can be guided downward along the guide grooves, and to be fitted into the engagement grooves 141B. Further, as described above, for the first embodiment, the tank holder 120 is supported by the tank holder support shafts 125 so pivotal, relative to the carriage 110, while in the second embodiment, fixed portions 148 are provided for both sides of the tank holder 140, and are securely fastened to the right and left sides of the carriage 110 by employing screws 148*a*. Further, slits 149 are formed along the right and left sides of the tank holder 140 between the fixed portions 148 and the engagement grooves 141B. Thus, flexible portions 146 can be obtained for the tank holder 140, i.e., even when the tank holder 140 is securely fastened to the carriage 110 at the fixed portions 148, the portions located between the engagement grooves 141B and the slits 149 are flexibly deformed in the rotational direction by employing end portions 149*a* of the slits 149 as the center. It should be noted that the other structure of the tank holder 140 is the same as that for the first embodiment.

In the state shown in FIG. 14, for a carrier unit 100 where the thus constructed tank holder 140 is provided, the head cartridge 200 has been mounted on the carriage 110, and thereafter the ink tanks 300 are attached thereto. As shown in FIG. 14, in the state wherein the ink tanks 300 are mounted on the carriage 110, the head cartridge 200 receives, as in the first embodiment in FIG. 12, a repulsive force F3 that is exerted by the close contact of ink supply ports 310 and rubber seal portions 205 at ink inflow portions 203. Further, as well as is shown in FIG. 12, the ink tanks 300 receive a repulsive force F4 in the reverse direction at the same strength as the force F3.

Furthermore, as in the first embodiment, first pawls 302 of the ink tanks 300 are directly fitted into pawl engagement holes 215 formed in the head cartridge 200. Therefore, the repulsive force F4 acts as a rotational force indicated by an arrow M4 in FIG. 14, and the tank holder 140 is moved in association with the ink tanks 300 by receiving the rotational force applied in the direction indicated by the arrow M2 in FIG. 14.

The tank holder 140 is securely fastened to the carriage 110 at the fixed portions 148, and the slits 149 formed on the right and left sides provide the flexible portions 146, which can be elastically deformed in the clockwise direction in FIG. 14. Therefore, the tank holder 140 is turned, at the end portions 149*a* of the slits 149, in association with the rotation of the ink tanks 300 indicated by the arrow M2, and is moved in the rotational direction. As a result, rough guide holding portions 142, located at the lower edges of the flexible portions 146, are brought into contact with protrusions 211 formed on the outer walls of the lower ends of the guide bosses 210, and thus, a contact force F6 is exerted against the head cartridge 200. The contact force F6 acts as a rotational force that pushes against the guide bosses 210 of the head cartridge 200 to pivot the head cartridge 200 in the direction indicated by the arrow M4 in FIG. 14. As a result, the rotational force in the direction indicated by the arrow M1, which acts on the head cartridge 200, and the rotational force in the direction indicated by the arrow M2 offset each other, and the head cartridge 200 maintains appropriate contact with the carriage 110. As a result, the same effects can be obtained as those obtained in the first embodiment.

As described above, according to the ink jet printing apparatus for the first and second embodiments, the repulsive force generated between the head cartridge and the ink tanks can be applied to the head cartridge via the tank holder. Therefore, regardless of the number of ink tanks to be mounted, the head cartridge can be appropriately held and fixed to the carriage, and the high-quality and accurate printing of an image can be performed. Furthermore, a complicated mechanism or member need not be additionally provided for the apparatus, and the apparatus can be provided at a low manufacturing cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-106983, filed May 8, 2012, which is hereby incorporated by reference herein in its entirety.

What is claimed is:

1. An ink jet printing apparatus comprising:

a head cartridge having an ink inflow portion;

a carriage on which the head cartridge is detachably mounted;

a tank holding member configured to be supported by the carriage and to move swingably;

an ink tank configured to store ink to be supplied to the head cartridge, the ink tank having an ink supply portion to be connected to the ink inflow portion, a first engagement portion to engage the head cartridge, and a second engagement portion to engage the tank holding member, wherein, when the head cartridge and the ink tank are mounted on the carriage, the ink tank is pivoted around the first engagement portion by receiving a force exerted against the ink supply portion via the ink inflow portion, and the tank holding member is pushed by the second engagement portion and is moved.

2. The ink jet printing apparatus according to claim 1, wherein the tank holding member pushes the head cartridge by being moved.

3. The ink jet printing apparatus according to claim 2, wherein the tank holding member is rotatably supported by the carriage; and wherein the tank holding member is to be moved by turning the tank holding member relative to the carriage.

4. The ink jet printing apparatus according to claim 3, wherein the tank holding member includes engagement grooves to engage guide bosses that are formed on side faces of the head cartridge; and wherein inner faces of the engagement grooves contact the guide bosses by moving the tank holding member.

5. The ink jet printing apparatus according to claim 1, wherein the head cartridge is pushed by an electrical contact portion provided for the carriage.

6. The ink jet printing apparatus according to claim 1, further comprising:

a fixing member for securely fixing the head cartridge to the carriage.

7. The ink jet printing apparatus according to claim 6, wherein a force that acts on the head cartridge, based on a pressing force exerted by the fixing member, is offset by a force that is exerted by the tank holding member to act on the head cartridge.

8. The ink jet printing apparatus according to claim 7, wherein the tank holding member includes engagement grooves to engage guide bosses that are formed on side faces of the head cartridge, fixed portions to be fixed to the carriage, and slits that are formed between the engagement grooves and the fixed portions; and wherein the flexible portion is provided by employing a portion between the slits and the engagement grooves.

9. The ink jet printing apparatus according to claim 1, wherein the tank holding member includes a flexible portion that is to be elastically deformed;

wherein the tank holding member is moved by the flexible portion that is elastically deformed by being pushed by the head cartridge; and wherein the flexible portion that is elastically deformed contacts the head cartridge.

* * * * *